US010493515B2

(12) United States Patent
Miller et al.

(10) Patent No.: US 10,493,515 B2
(45) Date of Patent: Dec. 3, 2019

(54) DEVICES AND METHODS FOR FORMING BOW SPRINGS OF ONE-PIECE CENTRALIZERS

(71) Applicant: Antelope Oil Tool & Mfg. Co., LLC, Mineral Wells, TX (US)

(72) Inventors: Eugene Edward Miller, Weatherford, TX (US); Everette H. Johnston, Perrin, TX (US); Jesse L. Neel, Willow Park, TX (US); Charles Carroll, Millsap, TX (US); George W. Ribble, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 663 days.

(21) Appl. No.: 14/707,845

(22) Filed: May 8, 2015

(65) Prior Publication Data

US 2016/0326813 A1 Nov. 10, 2016

(51) Int. Cl.
*B21D 11/10* (2006.01)
*B21J 1/04* (2006.01)
(Continued)

(52) U.S. Cl.
CPC ..... *B21D 53/00* (2013.01); *B21D 11/10* (2013.01); *B21D 22/025* (2013.01); *B21D 37/06* (2013.01); *E21B 17/1028* (2013.01)

(58) Field of Classification Search
CPC . E21B 17/1078; E21B 17/1028; B21D 53/00; B21D 11/10; B21D 53/886; B21D 5/01; B21D 5/02; B21D 7/06; B21D 5/002; B21D 5/0281; B21D 11/085; B21L 1/00; B21L 3/00; B21L 7/00; B21J 5/00;
(Continued)

(56) References Cited

U.S. PATENT DOCUMENTS 1,596,104 A 8/1926 Jeavons
3,312,285 A * 4/1967 Solum ..... E21B 17/1028 166/172
(Continued)

FOREIGN PATENT DOCUMENTS

GB 2427579 A 1/2007
WO 01/87513 A1 11/2001

OTHER PUBLICATIONS

Jong Kyung Lee (Authorized Officer), International Search Report and Written Opinion dated Aug. 17, 2016, PCT Application No. PCT/US2016/028879, filed Apr. 22, 2016, pp. 1-14.
(Continued)

*Primary Examiner* — Ryan J. Walters
*Assistant Examiner* — Lawrence Averick
(74) *Attorney, Agent, or Firm* — MH2 Technology Law Group LLP

(57) ABSTRACT

A device for forming bow springs in a one-piece centralizer includes a swing arm that is configured to receive the one-piece centralizer. The device and process using the device include mechanically applying, with a press, an external load onto an un-formed bow spring positioned on a form of the swing arm. When the load is applied with the device, the un-formed centralizer is forced downward to allow the bow spring to take the desired form/shape/geometry, length, and height of a formed bow spring.

16 Claims, 15 Drawing Sheets

(51) Int. Cl.

| | |
|---|---|
| ***B21D 53/88*** | (2006.01) |
| ***E21B 17/10*** | (2006.01) |
| ***B21D 53/00*** | (2006.01) |
| ***B21D 22/02*** | (2006.01) |
| ***B21D 37/06*** | (2006.01) |

(58) Field of Classification Search
CPC . B21J 1/04; B30B 13/00; B30B 11/02; B30B 11/04; B30B 15/02; B30B 15/06
See application file for complete search history.

(56) References Cited

U.S. PATENT DOCUMENTS 3,968,673 A * 7/1976 Ryan ..... B21D 28/06 29/414
4,088,186 A 5/1978 Callihan et al.
4,484,703 A * 11/1984 Kawasaki ..... B21D 53/00 228/144
4,641,776 A * 2/1987 Vlasek ..... E21B 17/1028 228/155
5,086,639 A * 2/1992 Wallman ..... B30B 15/044 100/231
5,375,445 A * 12/1994 Miller ..... B21D 35/00 72/16.7
5,553,382 A * 9/1996 Miller ..... B21D 35/00 267/163
5,566,754 A 10/1996 Stokka
5,575,333 A 11/1996 Lirette et al.
6,209,638 B1 4/2001 Mikolajczyk
6,533,034 B1 3/2003 Barger
6,637,511 B2 10/2003 Linaker
6,997,254 B2 * 2/2006 Jenner ..... E21B 17/1028 166/241.6
7,082,997 B2 8/2006 Slack
7,182,131 B2 2/2007 Gremillion
7,377,325 B2 5/2008 Trinder et al.
7,845,061 B2 * 12/2010 Buytaert ..... E21B 17/1028 166/241.6
7,849,918 B2 12/2010 Ehlinger et al.
7,878,241 B2 2/2011 Buytaert et al.
8,196,670 B2 6/2012 Jenner
D662,952 S 7/2012 Kirk et al.
D671,960 S 12/2012 Kirk et al.
8,555,964 B2 10/2013 MacLeod
D717,836 S 11/2014 Buytaert et al.
D717,837 S 11/2014 Buytaert et al.
D718,342 S 11/2014 Buytaert et al.
9,470,047 B2 * 10/2016 Kirk ..... E21B 17/1028
2003/0000607 A1 1/2003 Jenner
2003/0230411 A1 12/2003 Richard
2008/0283237 A1 * 11/2008 Buytaert ..... E21B 17/1028 166/196
2009/0008086 A1 1/2009 Ehlinger et al.
2009/0025929 A1 1/2009 Buytaert et al.
2009/0308615 A1 * 12/2009 Buytaert ..... E21B 17/1028 166/378
2010/0000287 A1 * 1/2010 Rusch ..... B21J 7/02 72/450
2012/0186828 A1 7/2012 Lively et al.
2013/0247698 A1 * 9/2013 Kosse ..... B30B 1/14 74/42
2013/0248207 A1 * 9/2013 Kirk ..... E21B 17/1028 166/381
2014/0096888 A1 * 4/2014 Buytaert ..... E21B 19/24 156/83
2015/0129200 A1 * 5/2015 Moore ..... E21B 17/00 166/241.6
2016/0273679 A1 * 9/2016 Rebholz ..... F16L 3/133

OTHER PUBLICATIONS

Frank Knecht (Examiner), Extended European Search Report dated Dec. 13, 2018, EP Application No. 16793140, filed Nov. 6, 2017, pp. 1-8.

* cited by examiner

DEVICES AND METHODS FOR FORMING BOW SPRINGS OF ONE-PIECE CENTRALIZERS

BACKGROUND

In hydrocarbon drilling operations, centralizers may be secured at spaced intervals along a tubular string. The centralizers provide a radial stand-off between the tubular and the wall of a drilled borehole in which the tubular is installed. Bow spring centralizers generally include collars defining a bore therethrough to receive the tubular, and a plurality of angularly-spaced bow springs biased to provide stand-off. Bow spring centralizers may collapse to pass, e.g., along with the tubular, through restrictions, and deploy to provide a generally uniform annulus between the exterior of the tubular and the wall of the borehole. Thus, for example in cementing operations, a bow spring centralizer promotes uniform and continuous distribution of cement slurry around the tubular string for cementing the tubular within a targeted interval of the borehole. The resulting cement liner may reinforce the tubular string, isolate the tubular from corrosive formation fluids and prevent fluid flow between penetrated geologic formations.

Currently, when forming a one-piece centralizer, an odd number of bow springs are usually required to be formed. This is because forming tool is positioned between opposing bow springs and expanded, thereby expanding the bow springs outward. With this process and tool, issues arise in forming a one-piece centralizer. For example, the forming process may not have the required stroke/length to appropriately form the opposite bow and therefore would not achieve desired dimensions of the centralizer, e.g., geometry, length, and height. Therefore, there is a need for devices and processes for forming bow springs in one-piece centralizers.

SUMMARY

Embodiments of the disclosure may provide a method that includes positioning a centralizer including a plurality of bow springs on a forming device. The forming device may include a press, a movable arm, and a form coupled to movable arm. The form is configured to shape the plurality of bow springs, and a first bow spring of the plurality of bow springs is positioned on the form. The method may also include actuating the press to apply pressure to the first bow spring between the form and the press. Additionally, the method may include repositioning the centralizer to position a second bow spring of the plurality of bow springs on the form, and actuating a press to apply pressure to the second bow spring.

Embodiments of the disclosure may also provide a device that includes a stand for receiving a centralizer having a plurality of bow springs. The stand may include a leg and an arm configured to receive the centralizer. The arm is movably coupled to leg to allow the arm to rotate about an axis of the leg. The stand may also include a form coupled to the arm, wherein the form is configured to shape the plurality of bow springs. The device may also include a press configured to apply pressure to at least one of the plurality of bow springs to shape the at least one of the plurality of bow springs on the form, and a control coupled to the press. The control is configured to actuate to the press to apply pressure to the at least one of the plurality of bow springs Embodiments of the disclosure may further provide a method including forming a one-piece centralizer comprising a first collar, a second collar, and a plurality of bow springs, and cutting the first collar and the second collar of the one-piece centralizer along a central axis to form two separate halves of the one-piece centralizer. The method may also include forming a plurality of hinges on each of the two halves of the one-piece centralizer, and reforming the one-piece centralizer by attaching the two halves at the plurality of hinges.

BRIEF DESCRIPTION OF THE DRAWINGS

Various features of the embodiments may be more fully appreciated, as the same become better understood with reference to the following detailed description of the embodiments when considered in connection with the accompanying figures, in which.

DETAILED DESCRIPTION

For simplicity and illustrative purposes, the principles of the present teachings are described by referring mainly to examples of various embodiments thereof. However, one of ordinary skill in the art would readily recognize that the same principles are equally applicable to, and may be implemented in, all types of information and systems, and that any such variations do not depart from the true spirit and scope of the present teachings. Moreover, in the following detailed description, references are made to the accompanying figures, which illustrate specific examples of various embodiments. Electrical, mechanical, logical and structural changes may be made to the examples of the various embodiments without departing from the spirit and scope of the present teachings. The following detailed description is, therefore, not to be taken in a limiting sense and the scope of the present teachings is defined by the appended claims and their equivalents.

Aspects of the present disclosure are directed to devices and process for forming bow springs in one-piece centralizers. The device includes a swing arm that is configured to receive the one-piece centralizer. The device and process using the device include mechanically applying, with a press, an external load onto an un-formed bow spring positioned on a form of the swing arm. When the load is applied with the device, the un-formed centralizer is forced downward to allow the bow spring to take the desired form/shape/geometry, length, and height of a formed bow spring. The forming process allows a centralizer with either an even or odd number of bows to be formed.

One example of a one-piece centralizer is a centralizer that is formed from a single tubular, e.g., by cutting, as described in U.S. Pat. No. 7,845,061. Another example of a one-piece centralizer is a centralizer formed from a flat plate that is rolled and then cut to form the end collars and ribs thereof, as disclosed in U.S. Patent Publication No. 2014/0096888. Still another example of a one-piece centralizer is formed as a flat plate, which is then cut and then rolled. The above-listed patent and publication are incorporated herein by reference to the extent not inconsistent with the present disclosure.

Figure 1:
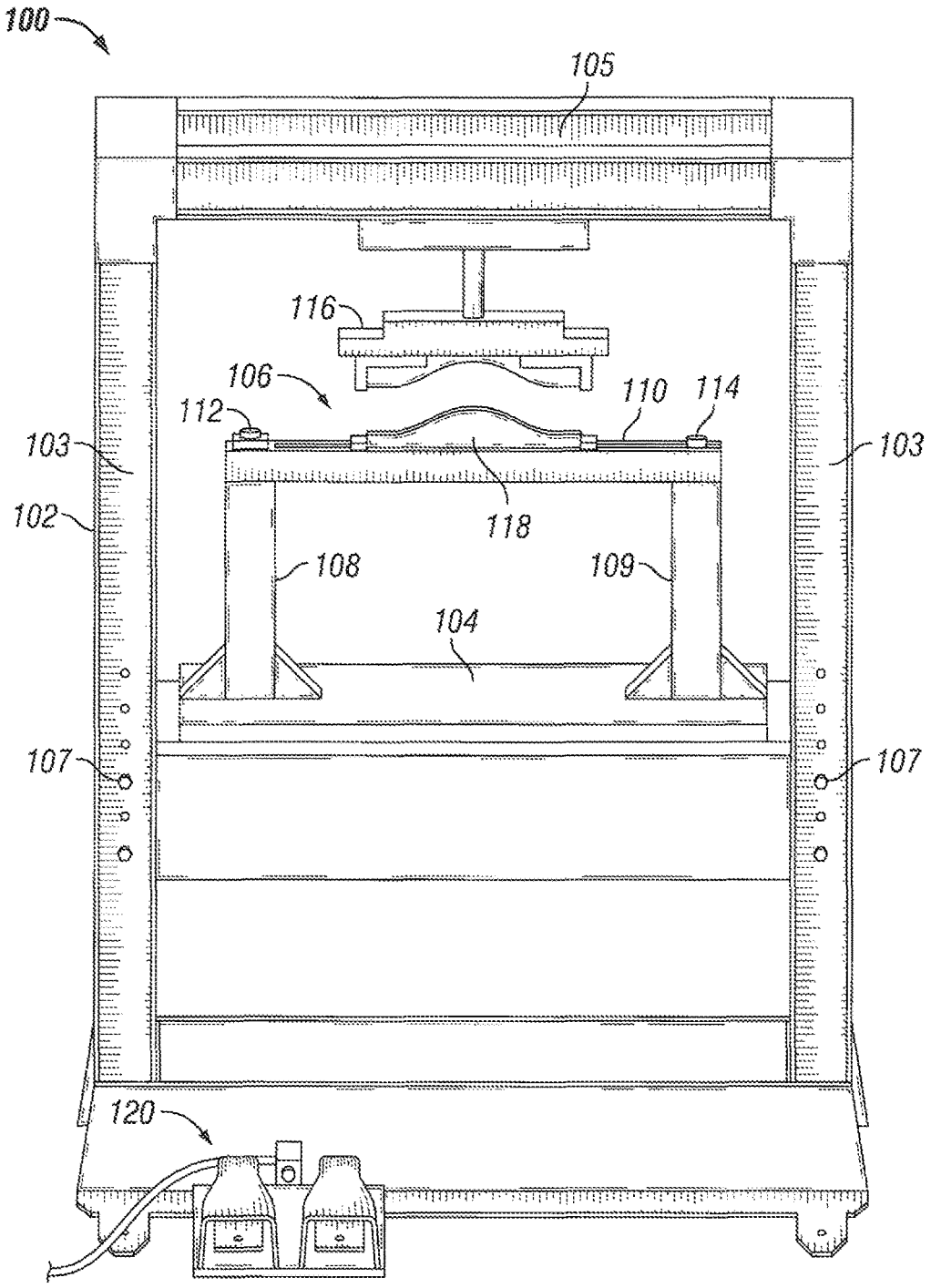
FIG. 1 illustrates a perspective view of a centralizer forming machine, according to an embodiment.

FIG. 1 illustrates a perspective view of a centralizer forming machine 100, according to an embodiment. While FIG. 1 illustrates various components contained in the centralizer forming machine 100, FIG. 1 illustrates one example of a centralizer forming machine and additional components may be added and existing components may be removed.

As illustrated in FIG. 1, the centralizer forming machine 100 includes a housing 102. In some embodiments, the housing 102 may be formed of two parallel and vertical legs 103 connected by a top cross bar 105. The top cross bar 105 may be coupled to the parallel legs 103 at the top of the parallel legs 103 to form a structure to support the components of the centralizer forming machine 100.

The centralizer forming machine 100 may include a platform 104. The platform 104 may be coupled to the parallel legs 103 to form a level platform to hold a stand 106. In some embodiments, the platform 104 may be moveably coupled to the parallel legs 103 by bolts 107. The bolts 107 may be removed to allow the platform 104 to be moved vertically upwards or downwards on the parallel legs 103.

The stand 106 may be formed of parallel and vertical legs 108 and 109. The legs 108 and 109 may support a swing arm 110. The swing arm 110 may be coupled to the leg 108 by a hinge 112. The hinge 112 may allow the swing arm 110 to swing about the axis of the leg 108. In some embodiments, the hinge 112 may include a bolt or pin coupled to the leg 108 and a circular hole in the swing arm 110 to receive the bolt or pin. The hinge 112 may allow the swing arm 110 to open perpendicular to a plane of the centralizer forming machine 100. The movement of the swing arm 110 may allow a one-piece centralizer to be positioned on the swing arm 110. The swing arm 110 may be coupled to the leg 109 by a locking pin 114. The locking pin 114 allows the swing arm 110 to be secured to the leg 109 to form a solid stand during the formation of bow springs of the one-piece centralizer.

The hinge 112 may allow the swing arm 110 to a swing across a range of angles, allowing the one-piece centralizer to be placed on the swing arm 110. In some embodiments, for example, the hinge 112 may allow the swing arm 110 to rotate to a point that is approximately 90 degrees perpendicular to a plane of the centralizer forming machine 100. But in other embodiments, the hinge 112 may allow the swing arm 110 to rotate to other angles.

The centralizer forming machine 100 may also include a press 116 and a form 118. The press 116 and the form 118 are configured to shape the bow spring of the one-piece centralizer when placed on the form 118. The press 116 may be coupled to the top cross bar 105. The form 118 may be coupled to the swing arm 110. In some embodiments, to form a bow spring, the swing arm 110 may be opened (e.g., swung away from the plane of the centralizer forming machine 100 by some degree) to allow positioning of a bow spring of a one-piece centralizer on the form 118, without disassembling or otherwise breaking-down the one-piece centralizer. Thus, the one-piece centralizer may be positioned around the swing arm 110, such that the swing arm 110 extends, e.g., at least partially between the end collars of the one-piece centralizer. Once placed, the swing arm 110 may be closed and secured in place by the locking pin 114. When locked by the locking pin 114, the form 118, with the positioned bow spring, may be positioned directly below the press 116.

The press 116 may be shaped as a concave curve to form the shape of a bow spring of the one-piece centralizer. The form 118 may be configured in a convex curve that mirrors the concave curve of the press 116. Thus, the form 118 may be disposed radially within the one-piece centralizer, while the press 116 may be formed radially outside of the one-piece centralizer. The press 116, when activated, moves onto the form 118, e.g., vertically, as shown. The press 116 and the form 118 may be positioned on the centralizer forming machine 100 so that convex and concave curves mate when the press 116 moves e.g., descends) onto the form 118. When a bow spring of the one-piece centralizer is positioned on the form 118, the press 116 compresses the bow spring against the form 118. The press 116 may apply a load on the bow spring to form the bow spring in the shape of the form 118. Once formed, the bow spring of the one-piece centralizer may have an outward bow in the shape of the form 118. The form 118 may be removed from the swing arm 110 and replaced with another form of a different size. In one embodiment, the one-piece centralizer may have different shaped bow springs by using different sized forms.

As such, the centralizer forming machine 100 may deform each bow spring in turn, without pushing against an opposing bow spring or, in this case, any adjacent bow springs. In some embodiments, however, the press 116 and/or form 118 may optionally be configured to receive two or more bow springs at a time, e.g., adjacent bow springs, so as to simultaneously expand two or three bow springs. In such case, however, the deformation of the two or more bow springs may occur without employing an opposing part of the centralizer to take up any reaction forces.

Although illustrated as pivoting or swinging through a horizontal plane, it will be appreciated that the swing arm 110 may swing through a vertical plane, or a plane disposed at any orientation between horizontal and vertical. Moreover, the press 116 may move perpendicular to the plane in which the swing arm 110 swings, whether vertical, horizontal, or therebetween. In other embodiments, the press 116 may move in a direction that is not perpendicular to the plane in which the swing arm 110 swings. In another embodiment, the form 118 may be moved toward the press 116.

The centralizer forming machine 100 may also include a control 120. The control 120 may be configured to activate the press 116. For example, the control 120 may be configured to cause the press vertically upwards and downwards (or otherwise toward and away from the press 116) in the centralizer forming machine 100. As illustrated, for example, the control 120 may be configured as one or more foot pedals. The foot pedals may be configured to actuate the press 116 upwards and downwards, respectively, by applying pressure with the ball or heal of a foot to the foot pedals. The foot pedal is one example of a control 120. The control 120 may be any type of electronic and/or mechanical and/or hydraulic and/or pneumatic control that actuates the press 116, for example, an electrical switch, electrical button, mechanical switch, mechanical button, etc.

Figure 2:
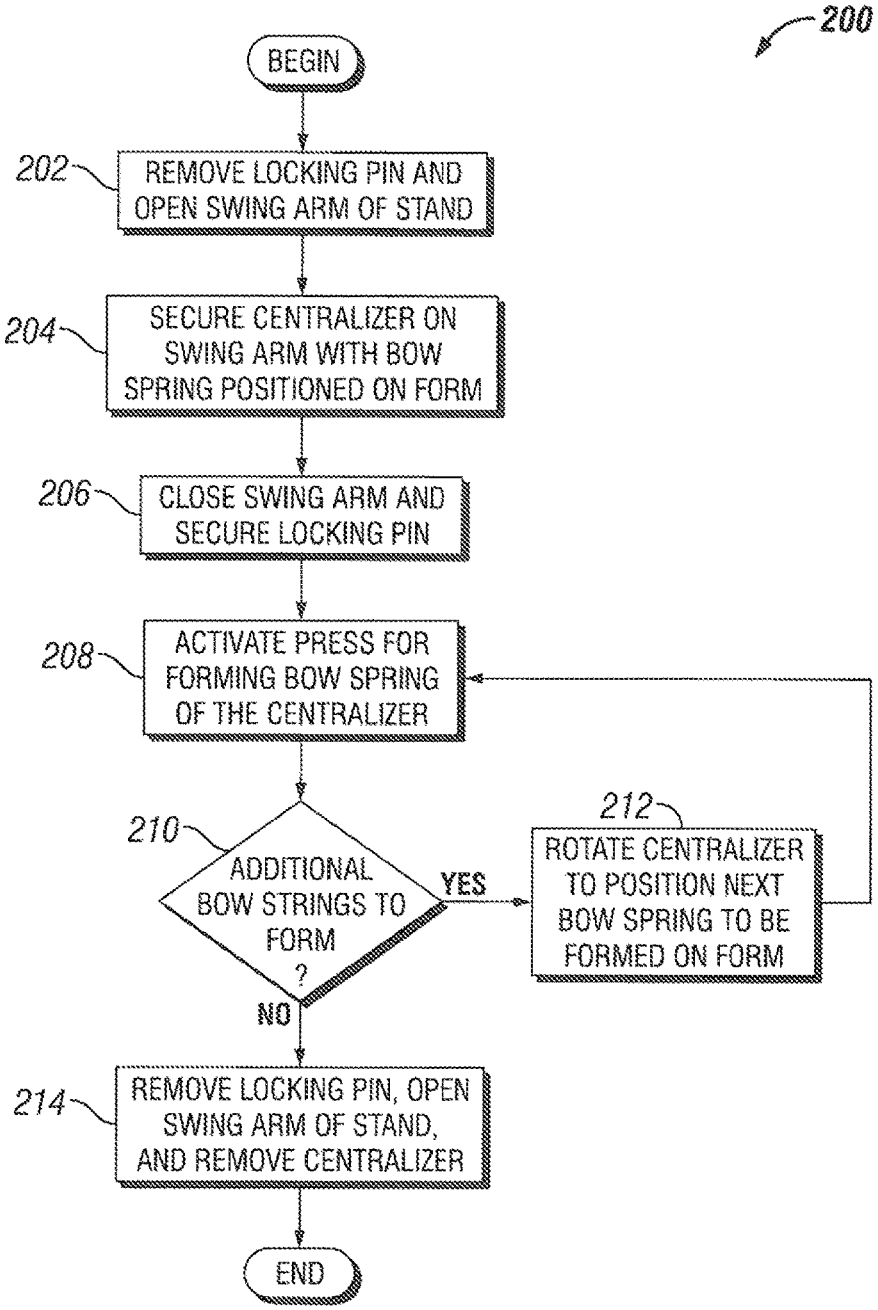
FIG. 2 illustrates a flowchart of a method for forming bow springs of a centralizer, according to an embodiment.

FIG. 2 illustrates a flowchart of a method 200 for using the centralizer forming machine 100 to shape the bow springs of a one-piece centralizer, according to an embodiment. FIGS. 3A-3G illustrate perspective views of the centralizer forming machine 100 during operation, according to an embodiment, e.g., pursuant to the method 200. The illustrated stages of the method 200 are examples and any of the illustrated stages may be removed or combined, additional stages may be added, and the order of the illustrated stages may be changed.

Figure 3A:
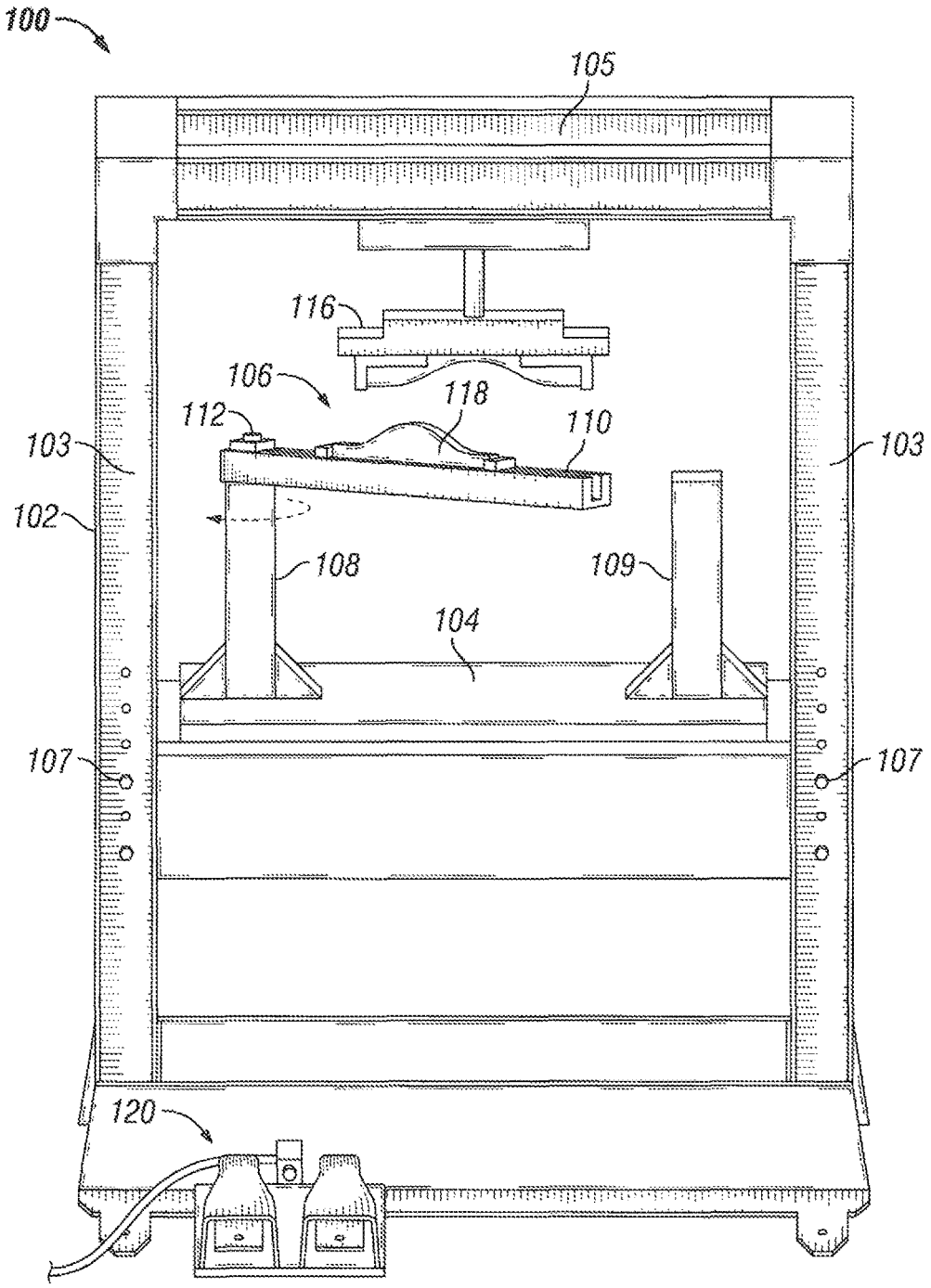
FIGS. 3A-3G illustrate perspective views of the centralizer forming machine forming a centralizer, according to an embodiment.

Once the process begins, in 202, the locking pin may be removed and the swing arm of the stand may be opened. For example, as illustrated in FIG. 3A, the swing arm 110 may be rotated outward about an axis of the leg 108. The swing arm 110 may be opened so that a one-piece centralizer may be placed on the swing arm 110.

Figure 3B:
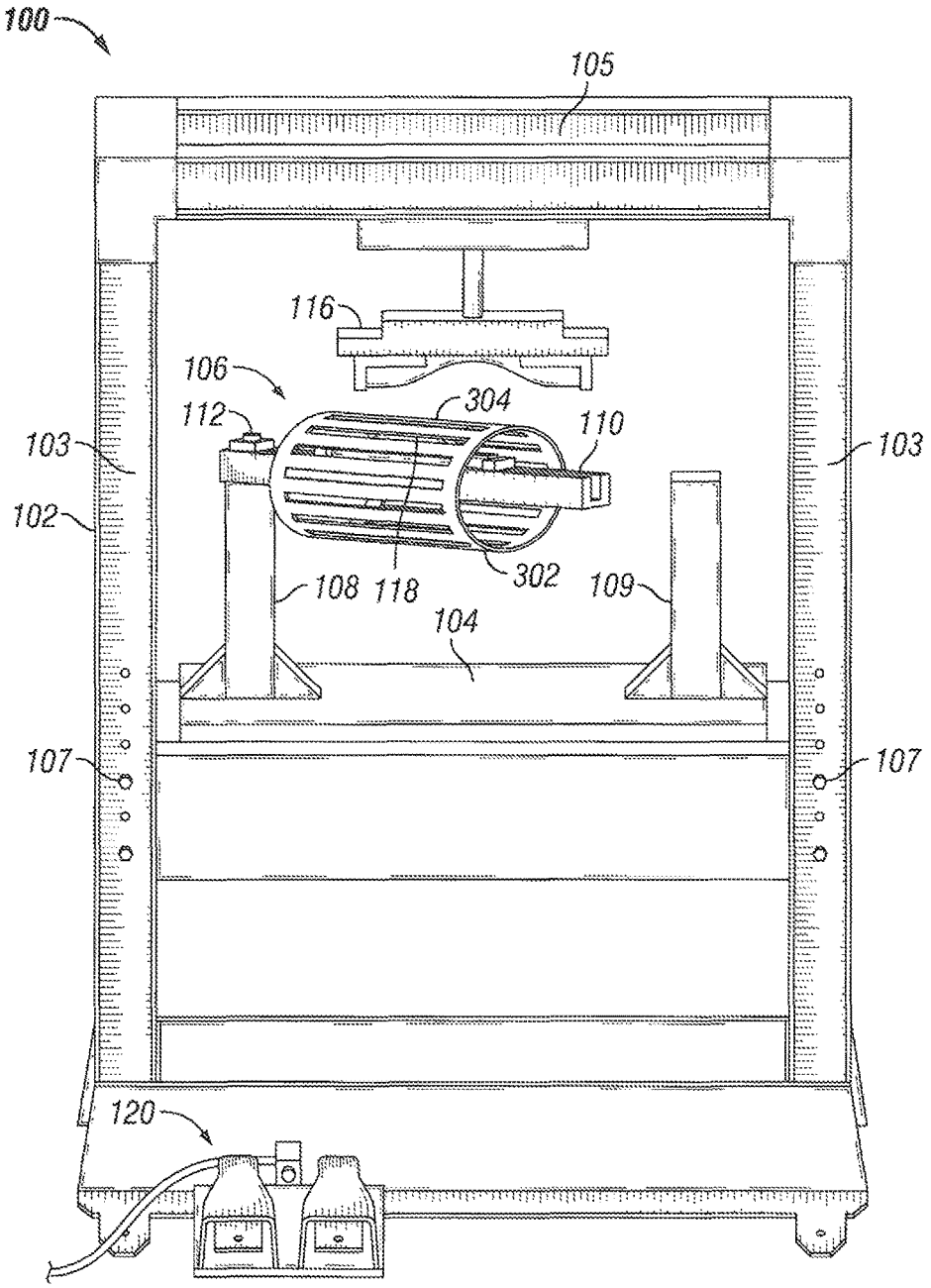

In 204, the centralizer may be secured to the swing arm and a bow spring of the centralizer may be position on the form. For example, as illustrated in FIG. 3B, a one-piece centralizer 302 may be placed on the swing arm 110 and a bow spring 304 may be positioned on the form 118. The bow spring 304 may be positioned on the form 118 so that the center of the bow spring 304 aligns with the center of the form 118, in some embodiments, the one-piece centralizer 302 may be secured in place on the form 118 by the weight of the one-piece centralizer 302. In some embodiments, the one-piece centralizer 302 may be secured in place on the form 118 by a mechanical device, such as a clamp.

Figure 3C:
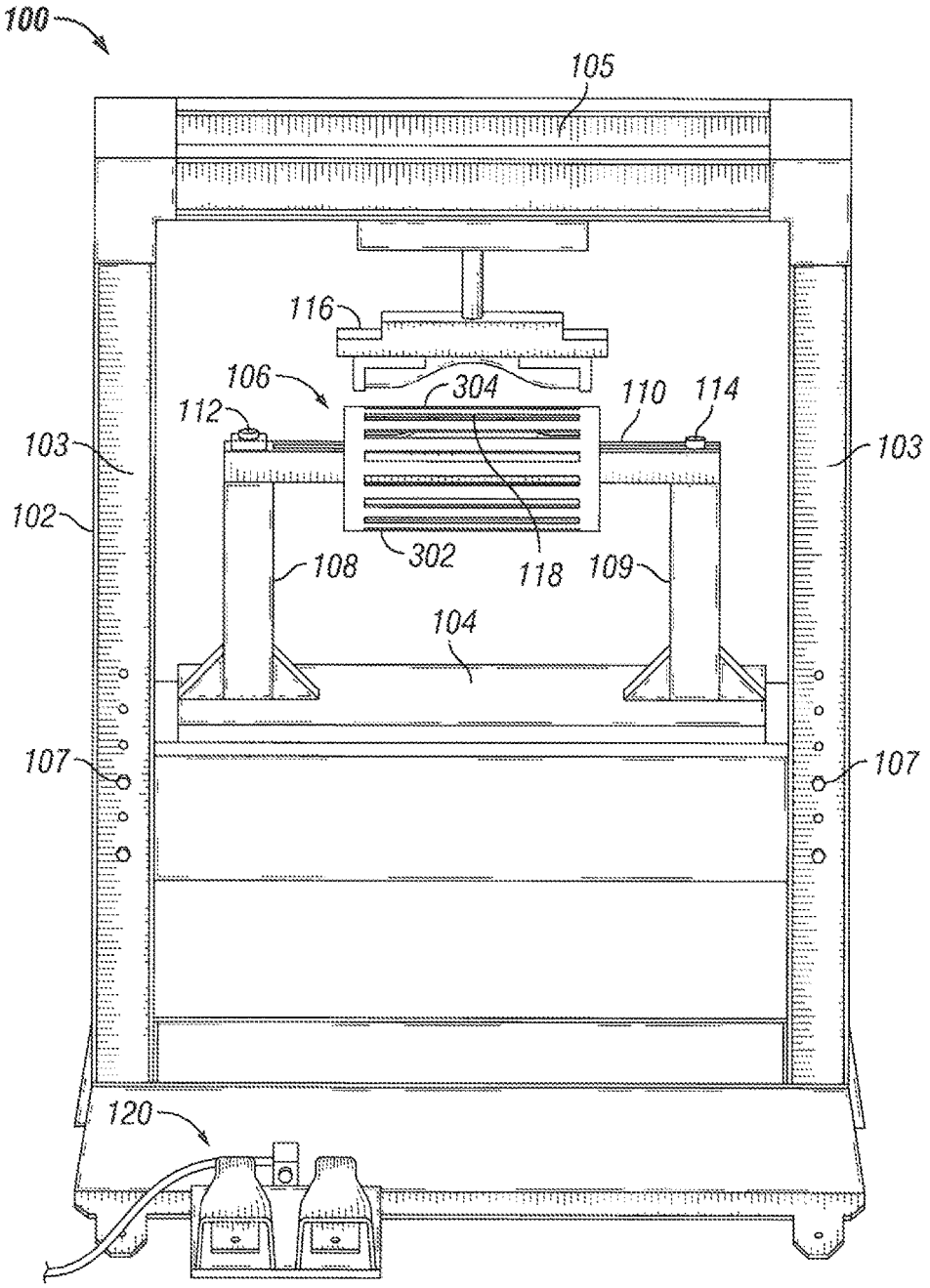

In 206, the swing arm may be closed and the locking pin may be secured. For example, as illustrated in FIG. 3C, the swing arm 110 may be closed, and the locking pin 114 may be secured. Once the swing arm 110 is closed, the form 118, supporting the bow spring 304, may be positioned directly below the press 116.

Figure 3D:
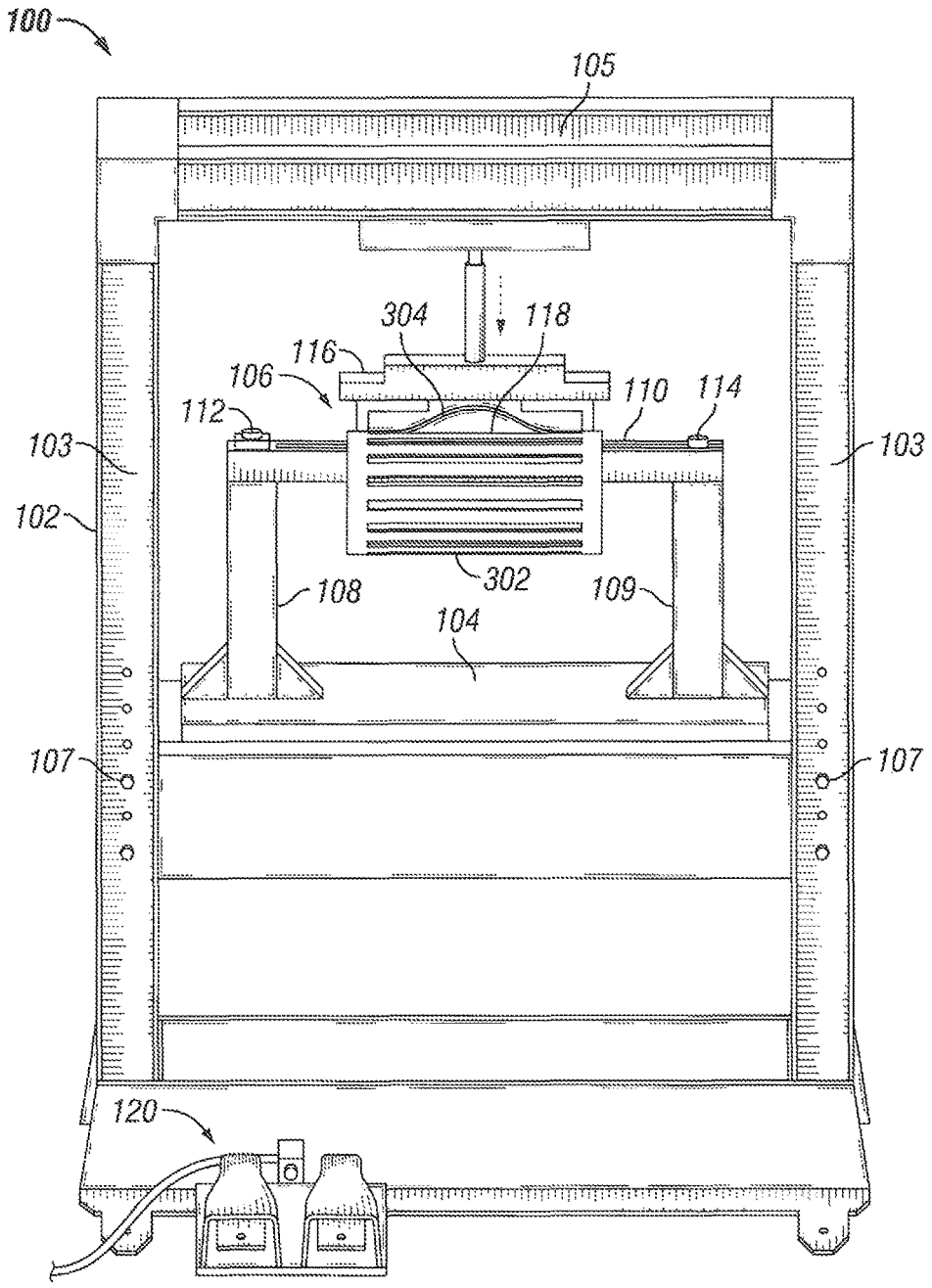
Figure 3E:
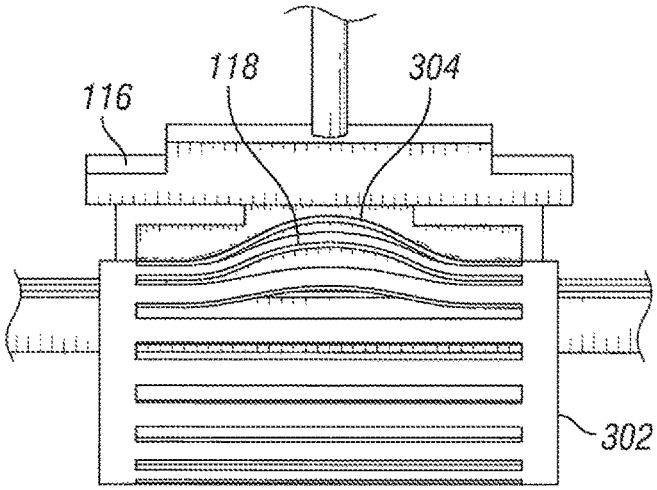
Figure 3F:
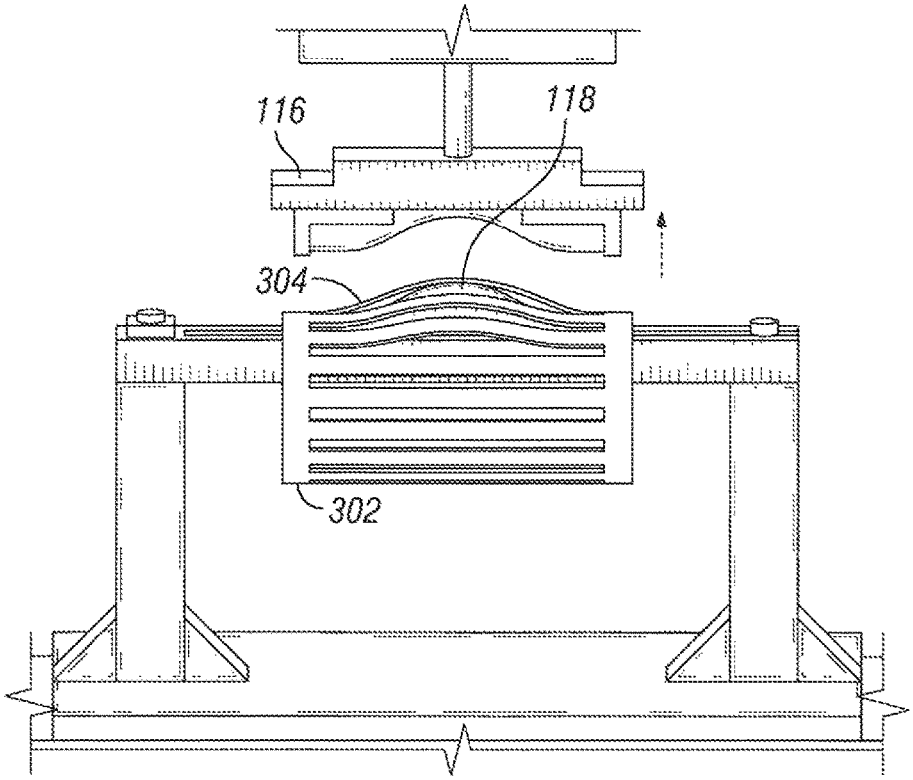

In 208, the press may be activated to form the bow spring of the one-piece centralizer. For example, as illustrated in FIG. 3D, the control 120 of the centralizer forming machine 100 may be actuated. Once the control 120 is actuated, the press 116 may descend and compress the bow spring 304 on the form 118. As illustrated in FIG. 3E, the load applied by the press 116 may cause the bow spring 304 to bend in the shape of the form 118. Once applied, the control 120 may again be actuated to move the press 116 upwards from the form 118. As illustrated in FIG. 3F, due to the load applied to the bow spring 304 and the metallurgical properties of the bow spring 304 material, the bow spring 304 may generally maintain the shape of the form 118.

Figure 3G:
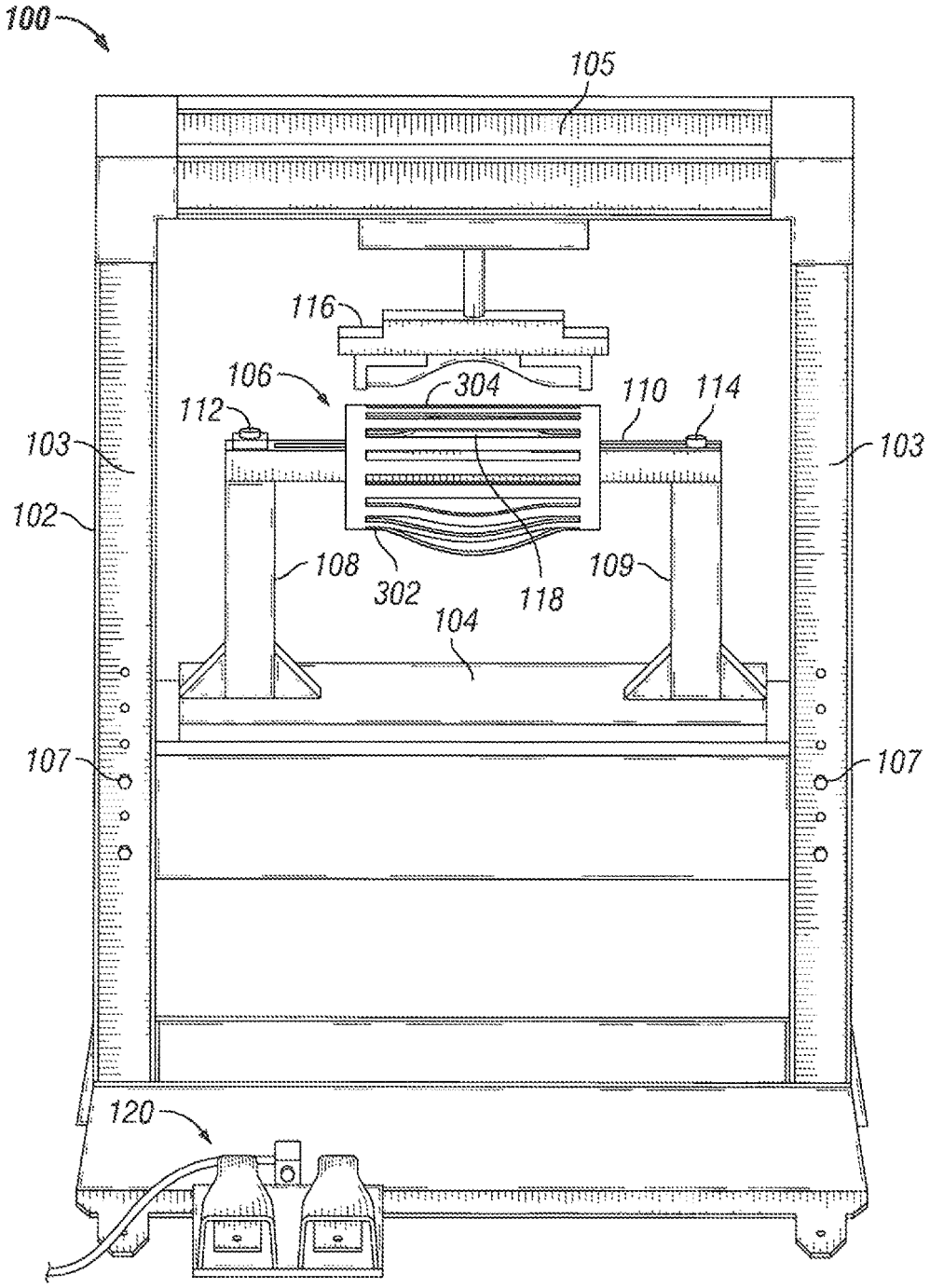

In 210, it may be determined whether additional bow springs are to be formed. If additional bow springs are to be formed, in 212, the centralizer may be rotated to position the next bow spring to be formed on the form. For example, as illustrated in FIG. 3G, the centralizer 302 may be rotated to another bow spring 304 that needs to be formed. Then, stage 208 may be repeated to form the bow spring 304.

Stages 208-212 may be repeated until some or all of the bow springs 304 have been formed. If all the bow springs have been formed, in 214, the locking pin may be removed, the swing arm may be opened, and the centralizer may be removed.

In embodiments described above, any type of one-piece centralizer may be utilized with the centralizer forming machine 100 and process 200. As used herein, a one-piece centralizer may include any centralizer formed in a cylindrical shape in which bow springs are to be formed. The centralizer forming machine 100 may be reconfigured to accommodate one-piece centralizers of different shapes and sizes. For example, in some embodiments, the centralizer forming machine 100 may be reconfigured with different shape and sized versions of the press 116 and the form 118 to accommodate one-piece centralizers of different shapes and sizes. In some embodiments, the platform 104 may be moved upwards and downwards to accommodate one-piece centralizers of different shapes and sizes.

As described above, the centralizer forming machine 100 may be configured so that the swing arm 110 rotates about a vertical axis of the leg 108. In this example, the press 116 and the form may be positioned such that the press 116 moves vertically to engage the form 118. This configuration is one example of the configuration of the components of the centralizer forming machine 100. The components may be configured in any orientation and position in the centralizer forming machine 100 that allow the swing arm 110 to move to review a one-piece centralizer and position the bow springs such that the press 116 can engage the form 118. In some embodiments, for example, the components of the centralizer forming machine may be configured so that the swing arm 110 rotates about a horizontal axis of the leg 108. For example, the stand 106 and/or platform may be coupled vertically to one of the legs 103 of the housing 102. In this example, the press 116 and the form may be positioned such that the press 116 moves horizontally to engage the form 118.

Figure 4:
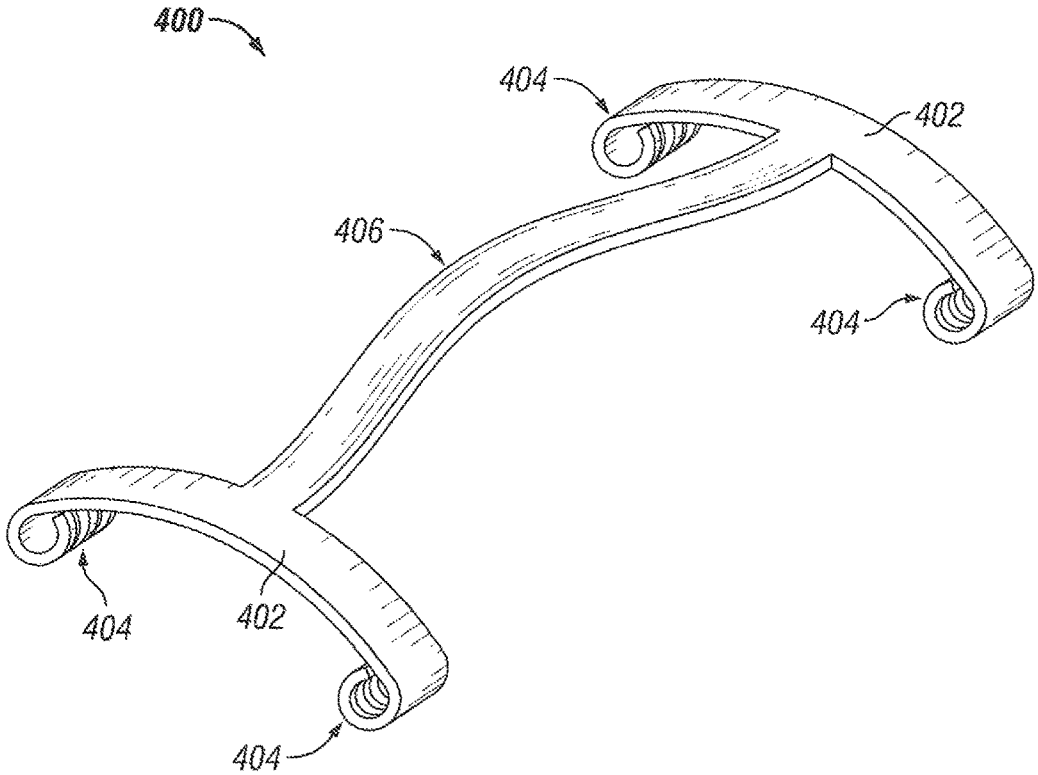
FIG. 4 illustrates a perspective view of a centralizer arm, according to an embodiment.

In some embodiments, the one-piece centralizer may be formed of one or more hinged centralizer arms. FIG. 4 illustrates an example of centralizer arm 400 that may be utilized to form a centralizer, according to various embodiments. While FIG. 4 illustrates various components contained in the centralizer arm 400, FIG. 4 illustrates one example of a centralizer arm and additional components may be added and existing components may be removed.

As illustrated in FIG. 4, the centralizer arm 400 may include a pair of end collars 402. Each of the end collars may include a number of hinges 404. The pair of end collars 402 may be coupled by a bow spring 406. The hinges 404 may be formed in a circular shape with a number of spaces and fingers. To form a centralizer, two or more centralizer arms 400 may be joined at the hinges 404.

Figure 5:
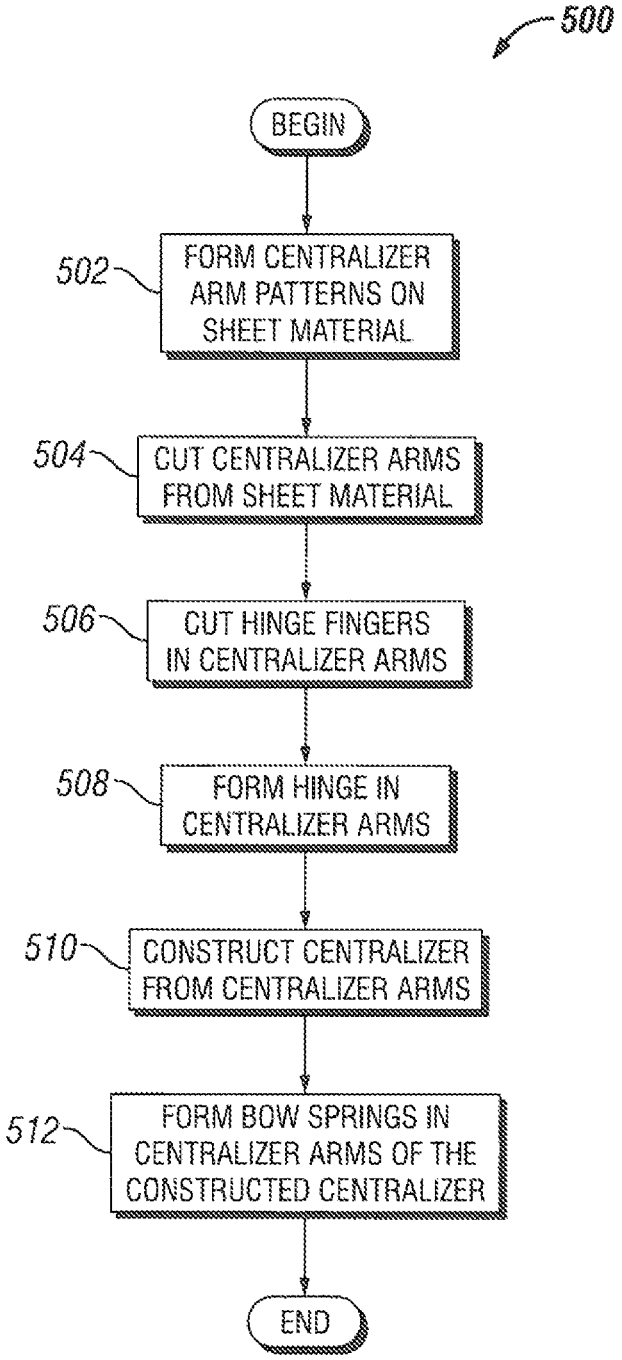
FIG. 5 illustrates a flowchart of a method for forming centralizer arms, according to an embodiment.
Figure 6A:
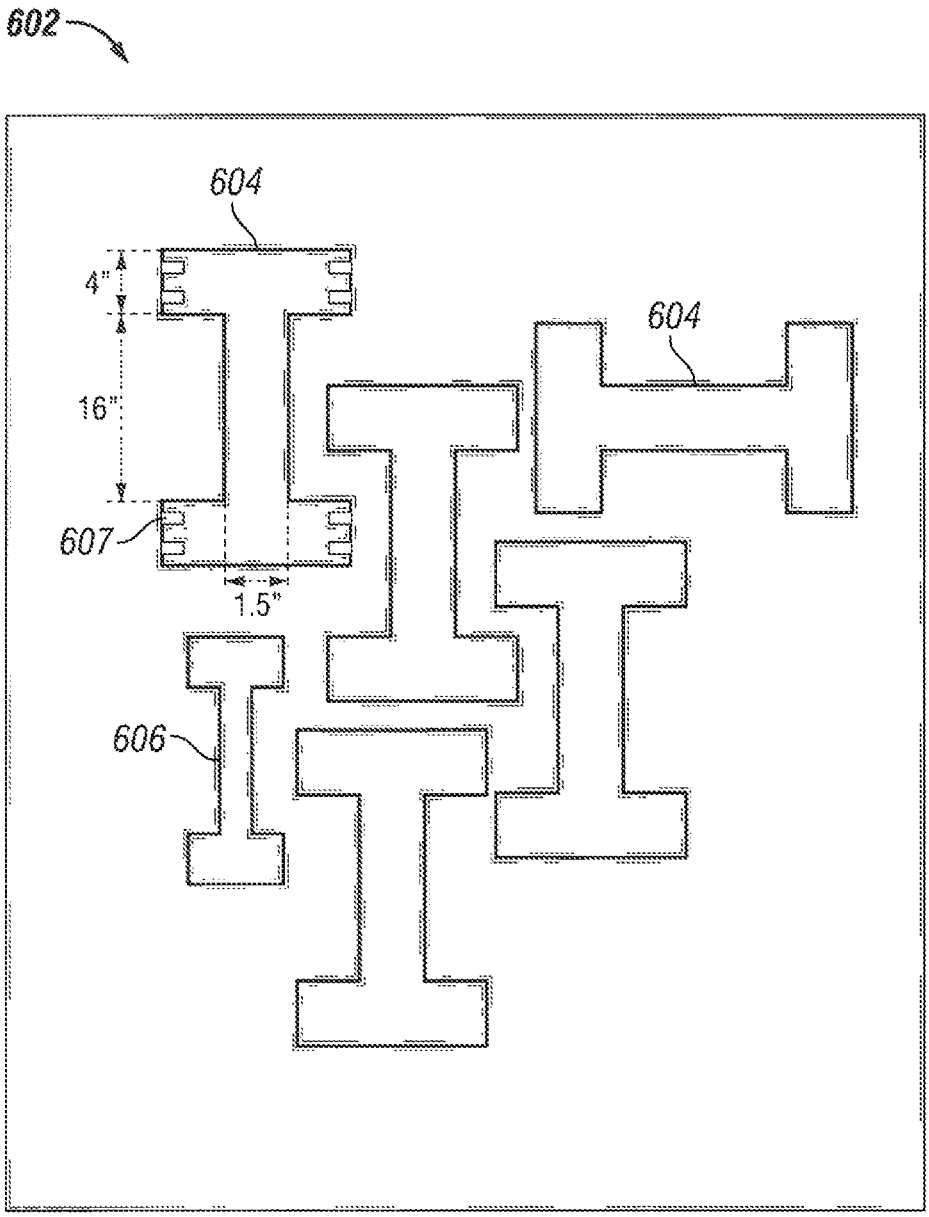
FIGS. 6A and 6B illustrate perspective views of the centralizer and the centralizer arms, according to an embodiment.
Figure 6B:
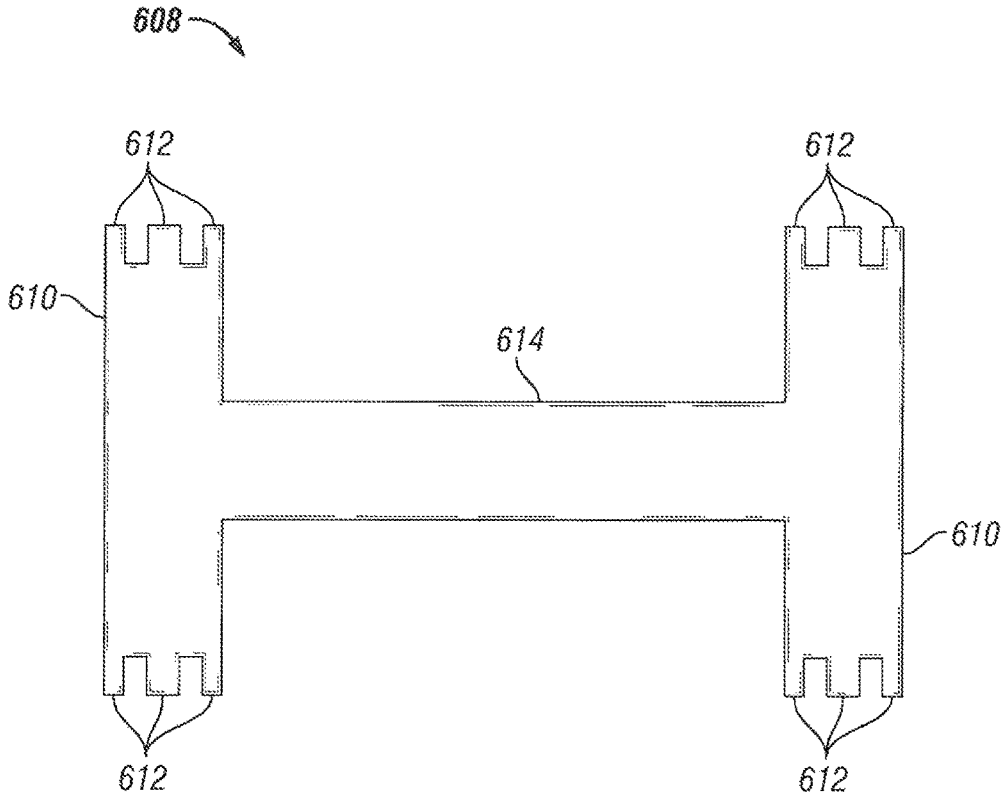

FIG. 5 illustrates a flowchart of a method 500 for forming a centralizer using hinged centralizer arms, according to an embodiment. FIGS. 6A and 6B illustrate views of the hinged centralizer arms during various stages of the method 500, according to an embodiment. The illustrated stages of the method are examples and that any of the illustrated stages may be removed, additional stages may be added, and the order of the illustrated stages may be changed.

Once the method 500 begins, in 502, centralizer arm patterns may be formed on a sheet of material. The centralizer arm patterns may be formed on the sheet of material in order to maximize the usage of the sheet for material. That is, the patterns may be placed on the sheet of material so that, once the centralizers arms are cut from the sheet of material, the scrap material produced is minimized.

For example, as illustrated in FIG. 6A, a number of centralizer arm patterns 604 may be formed on a sheet of material 602. The centralizer arm patterns 604 are formed of an "I" shape representing the collar and bow spring of the centralizer arm. The pattern may be formed to dimensions according to the desired centralizer arm dimensions. For example, in some embodiments, as illustrated in FIG. 6A, the width of the collar pattern may be between about 1 inch, 2 inches, 3 inches and about 5 inches, about 6 inches, or about 7 inches (e.g., approximately 4 inches), the width of the bow spring pattern may be between about 0.5 inches, about 0.75 inches, or about 1.00 inches and about 2.0 inches, about 2.5 inches, or about 3 inches (e.g., approximately 1.5 inches), and the length of the bow spring pattern may be between about 10 inches, about 12 inches, or about 14 inches and about 18 inches, about 20 inches, or about 22 inches (e.g., approximately 16 inches).

As illustrated, to maximize the usage of the sheet of material 602, the "I" shape patterns may be interlocked and arranged in different alignments so that the usage of the sheet of material 602 is maximized. The placement of the "I" shape patterns may be selected so that the amount of scrap produced is minimized. In some embodiments, a different sized centralizer arm pattern 606 may be formed in the sheet of material 602. By using different sized centralizer arm pattern 606, the usage of the sheet of material 602 may be maximized. In some embodiments, the centralizer arm patterns 604 may also include hinge finger patterns 607.

While FIG. 6A illustrates one configuration of the centralizer arm patterns, this configuration is but one example. The centralizer arm patterns may be formed on the sheet of material 602 in any configuration that maximizes the usage of the sheet of material 602, i.e. optimized so that the least amount of scrap is produced.

In some embodiments, for example, the sheet of material 602 may be a metal or metal alloy, for example, steel, aluminum, heat treatable steel, etc. The sheet of material 602 may formed to a thickness of the desired thickness of the centralizer arm. In some embodiments, the sheet of material 602 may be of a thickness that allows hinges to be formed in the collars of the centralizer arms and allows the bow springs to be formed. For example, the sheet of material 602 may have a thickness of between about 1/32 inch, about 1/16 inch, or about 1/10 inch and about 1/6 inch, about 1/5 inch, or about 1/4 inch thick (e.g., approximately 1/8 inch thick).

In 504, the centralizer arms may be cut from the sheet of material. In 506, hinge fingers may be cut into the centralizer arms. For example, in some embodiments, the centralizer arms may be cut from the centralizer arm patterns 604 and 606 using a laser. Likewise, for example, the centralizer arms may be cut from the centralizer arm patterns 604 and 606 using a punch press or a water-jet cutter. In some embodiments, the centralizer arm patterns 604 and 606 may include the finger patterns 607 and the hinge fingers may be cut as the centralizer arms are cut. In some embodiments, the hinge fingers may be cut after the centralizer arms are cut from the sheet of material 602.

For example, FIG. 6B shows an example of a centralizer min 608 cut from the sheet of material 602. As illustrated, the centralizer arm 608 may include a pair of collars 610 which include hinge fingers 612. The pair of collars 610 may be connected by a bow spring 614. When cut from the sheet of material 602, the centralizer arm 608 may have an approximately flat profile.

In 508, a hinge may be formed in the centralizer arm from the hinge fingers. In some embodiments, for example, the hinges may be formed by rolling the hinge fingers 612 of the collars 610 to form hinges.

In 510, a centralizer may be formed from the centralizer arms. For example, two or more the centralizer arms 608 may be joined to form a one-piece centralizer. The two or more centralizer arms 608 may be joined by welding, bolts, pins, and combinations thereof.

In 512, bow springs may be formed in the centralizer arms of the constructed centralizer. In some embodiments, the bow springs may be formed utilizing the centralizer forming device 100 and process 200 described above. Once the centralizer is formed, the centralizer may be heat treated.

In some embodiments, in an alternative to stages 510 and 512, the centralizer and bow springs may be formed by another heating and forming process. For example, the centralizer arm 608 may be placed in a heating furnace. Once heated, the centralizer arm 608 may be placed in a press with dies conforming to the desired shape. After formation, the heated centralizer arm may be quenched and tempered. In some embodiments, the centralizer arm 608 may include two or more bow springs 614.

Figure 7:
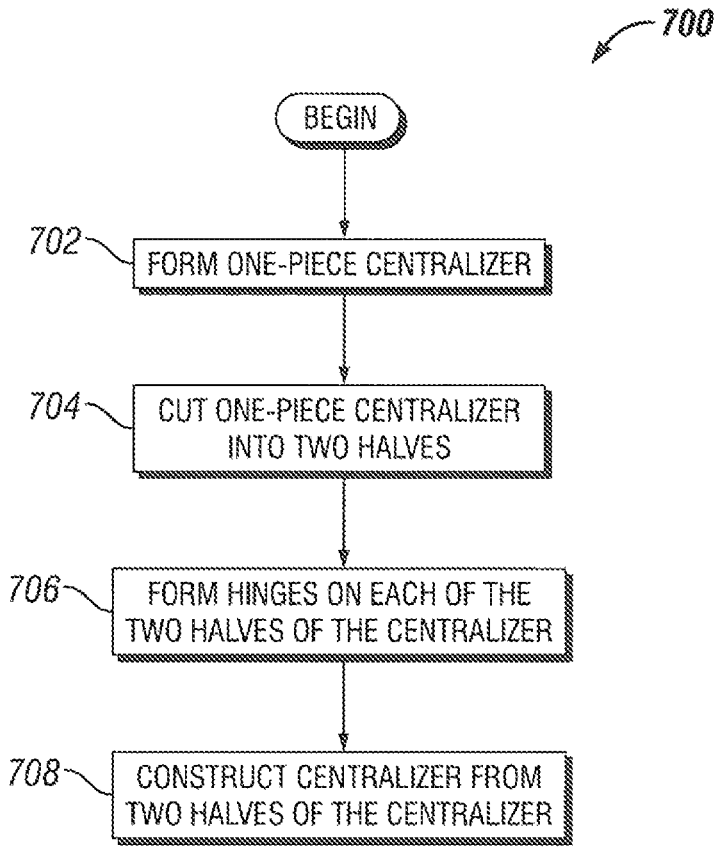
FIG. 7 illustrates a flowchart of a method for forming a centralizer, according to an embodiment.

In some embodiments, hinged centralizer arms may be formed from a solid, one-piece centralizer. FIG. 7 illustrates a flowchart of a method 700 for forming a centralizer having hinged centralizer arms formed from a solid, one-piece centralizer, according to an embodiment. FIGS. 8A-8D illustrate views of the centralizer arms during various stages of the method 700, according to an embodiment. The illustrated stages of the method 700 are examples and that any of the illustrated stages may be removed, additional stages may be added, and the order of the illustrated stages may be changed.

Once the method 700 begins, in 702, a one-piece centralizer may be formed. The one-piece centralizer may be formed of a solid body that includes two collars coupled by a number of bow springs. The one-piece centralizer may be formed using any processes and devices to form a one-piece centralizer.

Figure 8A:
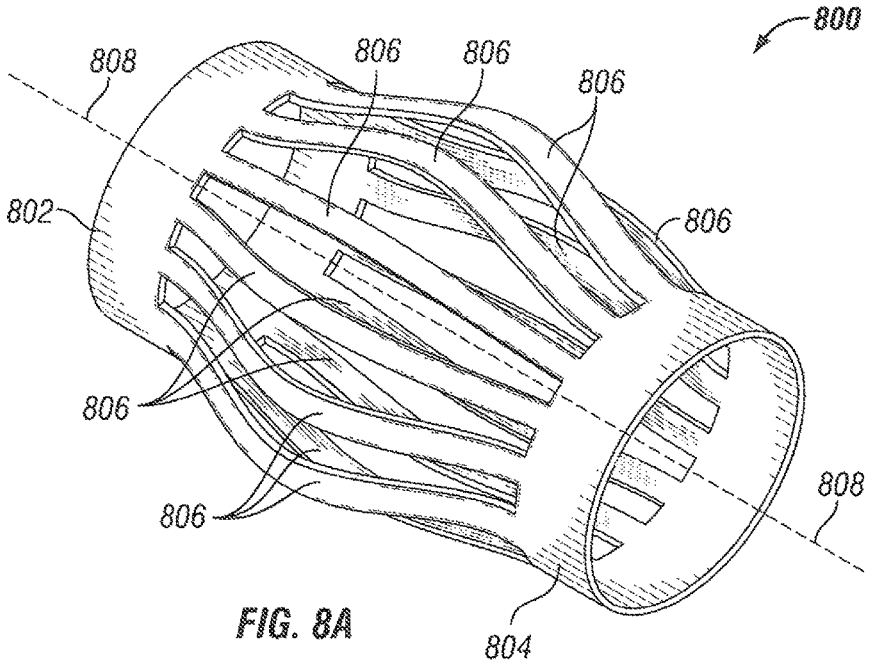
FIGS. 8A-8D illustrate perspective views of a centralizer, according to an embodiment.

For example, as illustrated in FIG. 8A, a one-piece centralizer 800 may include an upper collar 802 and a lower collar 804. The upper collar 802 and the lower collar 804 may be coupled to a number of bow springs 806.

In 704, the one-piece centralizer may be cut into two or more parts, for example, as shown, two halves. The one-piece centralizer may be cut into approximately equal halves by cutting the one-piece centralizer at the upper and lower collars along a central axis of the one-piece centralizer. The one-piece centralizer may be cut using any type of processes or devices, for example, a laser, a saw, water-jet, a cutting torch, etc.

Figure 8B:
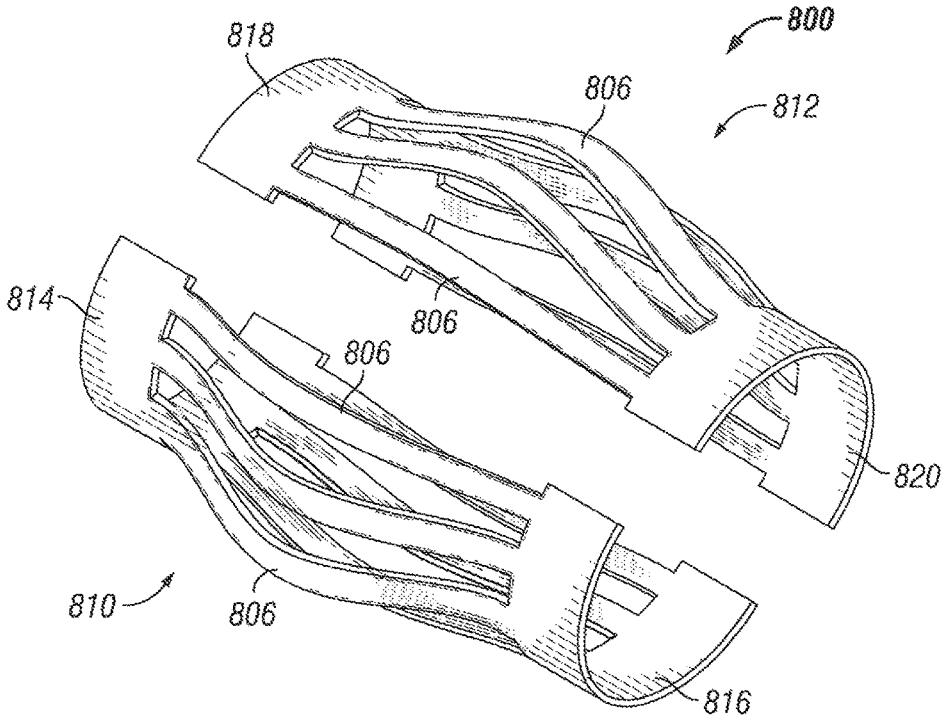

For example, as illustrated in FIG. 8A, the one-piece centralizer 800 may be cut into two approximately equal centralizer halves along a plane intersecting a central axis 808 of the one-piece centralizer 800. The one-piece centralizer 800 may be cut at the upper collar 802 and the lower collar 804 to form the approximately equal centralizer halves. As illustrated in FIG. 8B, once cut, the one-piece centralizer 800 may include a centralizer half 810 and a centralizer half 812. The centralizer half 810 may include an upper collar half 814 and a lower collar half 816. The upper collar half 814 and the lower collar half 816 may be coupled, e.g., integrally, to a portion of the bow springs 806. The centralizer half 812 may include an upper collar half 818 and a lower collar half 820. The upper collar half 818 and the lower collar half 820 can be coupled to a portion of the bow springs 806.

In 706, hinges may be formed on each of the two halves of the centralizer. The hinges may include eight hinges formed on each half of centralizer. The hinges may be formed on the collars of each half at the locations the collars were cut. The hinges may be formed using any conventional processes or devices. In some embodiments, the hinges may be formed separately and connected to the collars, e.g., welded, either on the exterior of the centralizer, on the interior of the centralizer, in the space created by cutting the centralizer in half, or any combination thereof. In some embodiments, the hinges may be formed from the material of the centralizer. For example, the hinges may be cut from the material of the centralizer.

Figure 8C:
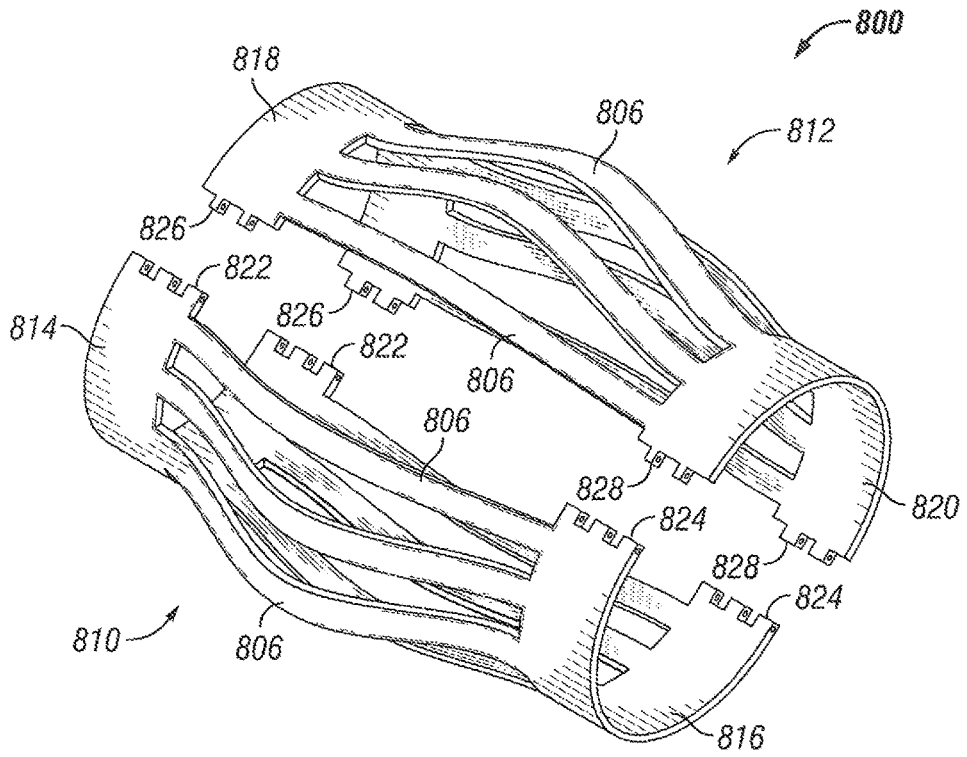

For example, as illustrated FIG. 8C, for the centralizer half 810, two hinges 822 may be formed on the upper collar half 814 and two hinges 824 may be formed on the lower collar half 816. For the centralizer half 812, two hinges 826 may be formed on the upper collar half 818 and two hinges 828 may be formed on the lower collar half 820. The two hinges 822 may be constructed so as to mate with the two hinges 826, thereby reforming the upper collar 802 when coupled together. Likewise, two hinges 824 may be constructed so as to mate with the two hinges 828, thereby reforming the lower collar 804 when coupled together.

In 708, the centralizer may be constructed from the two halves. The hinges of each half of the centralizer may be joined to reform the centralizer into one piece. The hinges may be joined using any process or device. For example, the hinges may be joined by a pin or other connector. The hinges allow the centralizer half 810 to rotate (or move) relative to the centralizer half 812. The movement of the centralizer halves 810, 812 allows the centralizer 800 to be placed around a tubular without sliding the centralizer onto the tubular from the end of the tubular. In some embodiments, the hinges may be welded together after being positioned on a tubular.

Figure 8D:
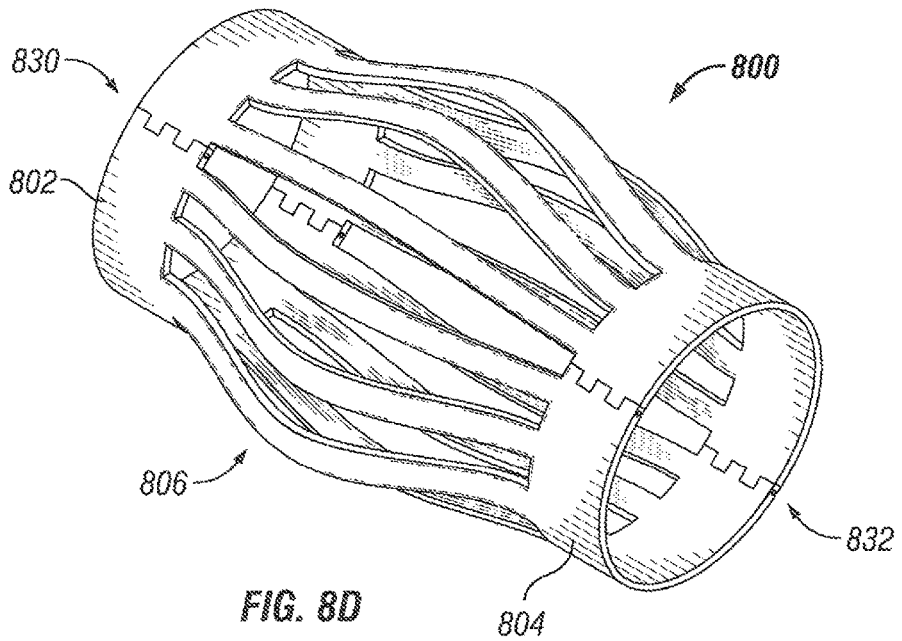

FIG. 8D illustrates the reformed centralizer 800. As illustrated, the upper collar 802 may be reformed by the joint 830 formed by the coupled hinges. Likewise, the lower collar 804 may be reformed by the joint 832 formed by the coupled hinges.

In the method 700 described above, the bow springs, for example, bow springs 806, may be shaped utilizing the processes and devices described above in FIGS. 1, 2, and 3A-3G. In some embodiments, the bow springs may be shaped prior to cutting and reforming the centralizer, e.g., prior to stage 702. In some embodiments, the bow springs may be shaped after cutting and reforming the centralizer, e.g., after stage 708. In other embodiments, the bow springs may be shaped, e.g., expanded, at any other time during the method 700.

While the teachings have been described with reference to examples of the embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Furthermore, to the extent that the terms "including", "includes", "having", "has", "with", or variants thereof are used in either the detailed description and the claims, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more."

Also, the term 'couple' or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Those skilled in the art will recognize that these and other variations are possible within the spirit and scope as defined in the following claims and their equivalents.

What is claimed is:

1. A method, comprising:

positioning a substantially cylindrical centralizer comprising a plurality of bow springs that are circumferentially-offset from one another on a forming device, the forming device comprising a press, a movable arm, and a form coupled to the movable arm, wherein the form and the press are configured to shape the plurality of bow springs, and wherein a first bow spring of the plurality of bow springs is positioned on the form;

actuating the press such that the press applies a radially-inward force on the first bow spring, such that the first bow spring is pressed between the form and the press, wherein the first bow spring is formed into a shape that corresponds to a shape of the press and a shape of the form, and wherein the shape of the first bow spring, after being formed, comprises a curved bow that is curved radially outward such that a distance between a central longitudinal axis of the centralizer and the curved bow increases proceeding from a first axial end of the centralizer toward a middle portion of the centralizer and decreases from the middle portion of the centralizer toward a second axial end of the centralizer;

rotating the centralizer to position a second bow spring of the plurality of bow springs on the form; and actuating the press to apply pressure to the second bow spring.

2. The method of claim 1, wherein positioning the centralizer comprises:

moving the movable arm about an axis of the forming device, wherein moving the movable arm allows the centralizer to be positioned on the form when the centralizer is substantially cylindrical.

3. The method of claim 2, wherein:

moving the movable arm comprises pivoting the movable arm, such that the form is moved away from the press;

positioning the centralizer comprises receiving the centralizer around the form while the form is moved away from the press and while the centralizer is substantially cylindrical; and the method further comprises pivoting the movable arm again, such that the form is aligned with the press, prior to actuating the press.

4. The method of claim 1, wherein actuating the press comprises moving the form, the press, or both radially, with respect to the centralizer, toward the other, so as to expand the first bow spring, without deforming the second bow spring such that the second bow spring remains substantially straight.

5. The method of claim 1, wherein the centralizer is a one-piece centralizer.

6. The method of claim 1, the method further comprising:

forming a plurality of centralizer arm patterns on a sheet of material, at least one of the centralizer arm patterns comprising a plurality of hinge finger patterns, wherein the plurality of centralizer arm patterns are formed on the sheet of material to maximize usage of the sheet of material;

cutting the at least one of the centralizer arm patterns from the sheet of material, wherein a centralizer arm formed by cutting the sheet of material comprises a plurality of hinge fingers; and forming, from the plurality of hinge fingers, at least one hinge on the centralizer arm.

7. The method of claim 6, wherein the at least one of the centralizer arm patterns further comprises a bow spring pattern and a collar pattern, and wherein the plurality of hinge finger patterns are formed in the collar pattern.

8. The method of claim 6, the method further comprising:

forming the centralizer from the centralizer arm and at least one additional centralizer arm, wherein the at least one hinge of the centralizer arm is coupled to the at least one additional centralizer arm.

9. The method of claim 6, wherein the forming the at least one hinge comprises rolling the plurality of hinge fingers to form the at least one hinge.

10. The method of claim 6, wherein the plurality of centralizer arm patterns comprise different-sized centralizer arm patterns.

11. The method of claim 1, the method further comprising:

cutting the centralizer along a central axis to form two halves of the centralizer;

forming a plurality of hinges on each of the two halves of the centralizer; and reforming the centralizer by attaching the two halves at the hinges.

12. The method of claim 1, wherein the centralizer is positioned around at least a portion of the movable arm and the form, such that the form is entirely within the centralizer.

13. The method of claim 1, wherein the press defines a concave arc and the form defines a convex arc, wherein the first bow spring is bent radially outward between the concave arc and the convex arc, such that at least a portion thereof forms an arc that complements the concave arc and the convex arc.

14. The method of claim 1, wherein the first bow spring maintains the shape of the form due to the radially-inward force applied to the first bow spring and metallurgical properties of the first bow spring.

15. The method of claim 1, wherein an axial slot is formed in the centralizer circumferentially-between each adjacent pair of bow springs.

16. A method, comprising:

positioning a substantially cylindrical centralizer comprising a plurality of bow springs that are circumferentially-offset from one another on a forming device, the forming device comprising a press, a movable arm, and a form coupled to the movable arm, wherein the form and the press are configured to shape the plurality of bow springs, and wherein a first bow spring of the plurality of bow springs is positioned on the form;

actuating the press such that the press applies a radially-inward force on the first bow spring, such that the first bow spring is pressed between the form and the press, wherein the first bow spring is formed into a shape that corresponds to a shape of the press and a shape of the form, wherein the first bow spring extends between two collars of the centralizer, and wherein the first bow spring, after being formed, extends radially-outward farther than the two collars;

rotating the centralizer to position a second bow spring of the plurality of bow springs on the form; and actuating the press to apply pressure to the second bow spring.

* * * * *